US008684573B2

(12) United States Patent
Lee et al.

(10) Patent No.: US 8,684,573 B2
(45) Date of Patent: Apr. 1, 2014

(54) LIGHT BEAM ADJUSTING DEVICE FOR VEHICLE

(75) Inventors: Jihn Shium Lee, Tainan (TW); Jen Mao Wang, Changhua (TW)

(73) Assignees: Fu An Industrial Co., Ltd., Anping Industrial Dist., Tainan (TW); Get Auto Accessories Co., Ltd., Changhua (TW)

( * ) Notice: Subject to any disclaimer, the term of this patent is extended or adjusted under 35 U.S.C. 154(b) by 121 days.

(21) Appl. No.: 13/478,187

(22) Filed: May 23, 2012

(65) Prior Publication Data

US 2013/0314924 A1 Nov. 28, 2013

(51) Int. Cl.
*F21V 17/02* (2006.01)

(52) U.S. Cl.
USPC ..... 362/513; 362/539; 362/282

(58) Field of Classification Search
USPC ..... 362/277, 280–282, 299, 319, 321, 322, 362/326, 327, 351, 464, 509, 512–516, 538, 362/539
See application file for complete search history.

(56) References Cited

U.S. PATENT DOCUMENTS

| | | | | |
|---|---|---|---|---|
| 5,899,559 | A | 5/1999 | Lachmayer et al. | |
| 6,325,528 | B1 | 12/2001 | Wittmeier et al. | |
| 6,386,744 | B1 | 5/2002 | Scholl | |
| 6,607,295 | B2 | 8/2003 | Hayakawa | |
| 7,201,502 | B2 | 4/2007 | Tsai | |
| 7,370,996 | B2 | 5/2008 | Ohshio | |
| 8,104,940 | B2 * | 1/2012 | Ochiai | 362/512 |
| 2007/0147061 | A1 | 6/2007 | Lee et al. | |

* cited by examiner

*Primary Examiner* — Hargobind S Sawhney
(74) *Attorney, Agent, or Firm* — Charles E. Baxley

(57) ABSTRACT

A light beam adjusting device includes a housing having a reflector, a light device disposed within the reflector for generating light which may be reflected partially upwardly and partially downwardly by the reflector. The light reflected downwardly by the reflector is allowed to emit out through the housing. A shielding panel is disposed in the housing, and an actuating device may rotate the shielding panel to open and block the lower portion of the housing, and to selectively open and block the light reflected upwardly by the reflector. The light reflected upwardly by the reflector may form a high beam together with the downwardly reflected light when the housing has not been blocked by the shielding panel.

5 Claims, 3 Drawing Sheets

LIGHT BEAM ADJUSTING DEVICE FOR VEHICLE

BACKGROUND OF THE INVENTION

1. Field of the Invention

The present invention relates to a vehicle headlight adjusting device, and more particularly to a vehicle headlight having a light beam adjusting device for adjusting the headlight to different light beams or to different light intensities and having a greatly simplified structure for reducing the manufacturing cost and for simplifying the assembling procedures.

2. Description of the Prior Art

Typical vehicle headlights comprise a light beam adjusting device to adjust the headlight to different light beams or to different light intensities, such as to the high beam and to the low beam. For example, the typical vehicle light beam adjusting devices comprise a light bulb or light device slidably received or extended or engaged in a reflector, and movable relative to the reflector, in order to adjust to different light beams.

For example, U.S. Pat. No. 5,899,559 to Lachmayer et al. discloses one of the typical vehicle headlights including a light beam adjusting device having a light bulb received within a reflector and coupled to a light source base. However, the typical vehicle headlights include a complicated structure that may not be easily manufactured and assembled.

U.S. Pat. No. 6,325,528 to Wittmeier et al. discloses another typical vehicle headlight including a light beam adjusting device having a light bulb slidably or movably received within a reflector and coupled to a light source base which is tiltable and rotatable or actuatable relative to the reflector by an electromagnetic solenoid, in order to adjust the typical vehicle headlights to different light beams. However, some of the light portion generated by the light bulb may be reflected or emitted upwardly by the reflector in order to form the high beam inadvertently which is adverse for the drivers of the head to head vehicles.

U.S. Pat. No. 6,386,744 to Scholl discloses a further typical vehicle headlight including a light source mounted in a reflector, and light ray stop having a pot-shaped region arranged to block off a part of the light from the light source so that it does not reach the reflector. However, the typical vehicle headlight may not be adjusted to different light beams.

U.S. Pat. No. 6,607,295 to Hayakawa discloses a still further typical vehicle headlight including a light source mounted in a reflector, and a shade pivotally attached to a holder with pivot pins and engaged with a plunger of a solenoid which may actuate the shade to block off a part of the light from the light source. However, the plunger of the solenoid may have a good chance to slide or move or slip relative to the shade such that the shade may not be effectively operated or actuated by the plunger of the solenoid.

U.S. Pat. No. 7,201,502 to Tsai discloses a still further typical vehicle headlight including a light source mounted in a reflector, and a shade or panel slidably attached to a holder or frame with guide pins and engaged with a core of a solenoid which may actuate the panel to block off a part of the light from the light source. However, the sliding attachment of the panel to the holder frame includes a complicated structure that may not be easily manufactured and assembled.

U.S. Pat. No. 2007/0147061 to Lee et al., the present inventors, discloses a still further typical vehicle headlight including a light source mounted in a reflector, and a shade or panel pivotally attached to a holder or frame with guide pins and engaged with a core of a solenoid which may actuate the panel to block off a part of the light from the light source. However, the actuator includes an unsafe structure that may have a good chance to be separated or disengaged from the core of the solenoid inadvertently.

U.S. Pat. No. 7,370,996 to Ohshio discloses a still further typical vehicle headlight including a light source mounted in a reflector, and a shade or panel for blocking off a part of the light from the light source. However, the typical vehicle headlight includes a complicated structure that may not be easily manufactured and assembled.

The present invention has arisen to mitigate and/or obviate the afore-described disadvantages of the conventional vehicle light beam adjusting devices.

SUMMARY OF THE INVENTION

The primary objective of the present invention is to provide a vehicle light beam adjusting device for adjusting the headlight to different light beams or to different light intensities, and for preventing the light portion generated by the light bulb from being reflected or emitted upwardly as a high beam by the reflector of the vehicle headlight.

The other objective of the present invention is to provide a vehicle light beam adjusting device including a greatly simplified structure for reducing the manufacturing cost and for simplifying the assembling procedures.

In accordance with one aspect of the invention, there is provided a light beam adjusting device comprising a housing including a reflector, a light device attached to the reflector for generating light, and for allowing the light to be selectively reflected upwardly and to be selectively reflected downwardly by the reflector, the light reflected downwardly by the reflector being allowed to emit out through the housing, a frame attached to the housing, and including a passage formed therein for allowing the light reflected upwardly by the reflector to selectively emit out through the passage of the frame, and including two ears extended therefrom, a shielding panel including two arms extended therefrom and pivotally coupled to the ears of the frame with a pivot axle to allow the shielding panel to be pivoted relative to the frame with the pivot axle and to be pivoted relative to the frame between an upwardly working position to selectively block the passage of the frame and a downwardly receiving position to selectively open the passage of the frame, a solenoid device including a coil and a core slidably received in the coil and movable relative to the solenoid device by the coil, the core including a head provided on a free end portion thereof and having an annular groove formed in the head, an actuator including two end rods coupled to the arms of the shielding panel respectively and spaced away from the pivot axle, and including a U-shaped anchoring member provided in a middle portion thereof to slidably engage with the annular groove of the head and to be slidably coupled to the core of the solenoid device for rotating the shielding panel relative to the frame to selectively open and block the passage of the frame, the anchoring member including two side bars slidably engaged with the annular groove of the head of the solenoid device and an end bar connected between the side bars for forming the U-shaped structure of the anchoring member and for forming an opening in the actuator, the opening being formed and located between the side bars and the end rods, and the end bar being located distal to the end rods and parallel to the end rods for stably anchoring and retaining the head of the solenoid device to the actuator and for preventing the anchoring member of the actuator from being separated and disengaged from the core of the solenoid device, and a spring biasing member engaged onto the core and engaged with the core for biasing the core relative to the coil of the solenoid device, the core of the solenoid device is coupled to the anchoring member of the actuator for actuating the actuator to pivot or rotate the shielding panel to selectively open the passage of the frame and to allow the light reflected upwardly by the reflector to selectively emit out through the passage of the frame, the spring biasing member may bias the core and the actuator to rotate the shielding panel to selectively block the passage of the frame and to prevent the light reflected upwardly by the reflector from emitting out through the passage of the frame when the core is not actuated by the coil of the solenoid device, the light reflected upwardly by the reflector may form a high beam together with the light reflected downwardly by the reflector when the passage of the frame is opened and is not blocked by the shielding panel.

The actuator is formed with a longitudinal cable having a circular cross section. The core includes a peripheral shoulder formed by the head and engaged with the spring biasing member.

The arms of the shielding panel each include a root portion and a free end portion, the pivot axle is attached to the root portions of the arms of the shielding panel, and the end rods of the actuator are attached to the free end portions of the arms of the shielding panel and spaced from the pivot axle. The arms of the shielding panel are inclined or tilted relative to the shielding panel.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 2:
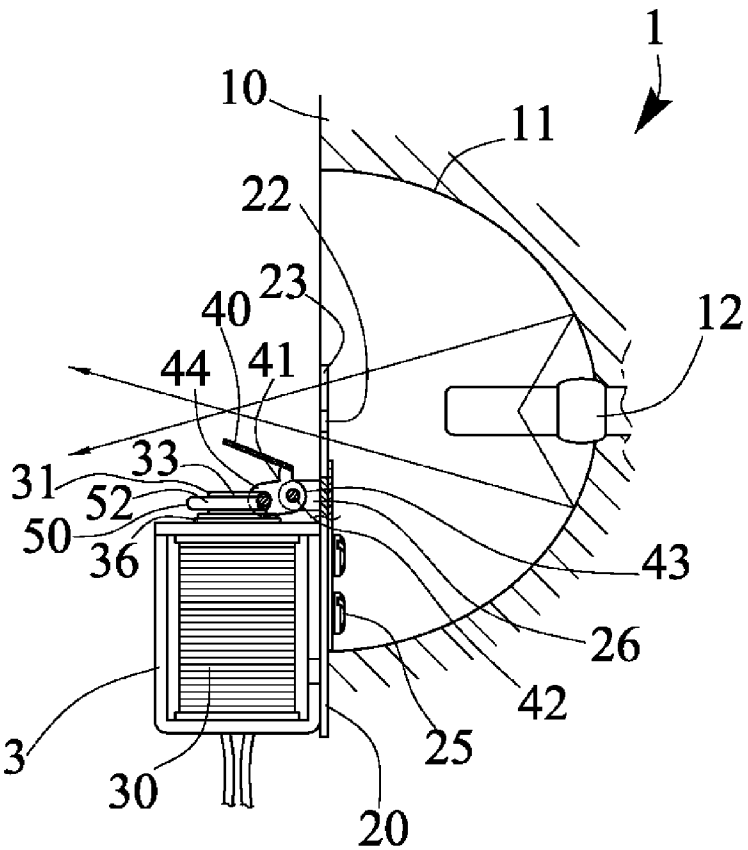
FIG. 2 is another side plan schematic view similar to FIG. 1, illustrating the operation of the vehicle light beam adjusting device.
Figure 1:
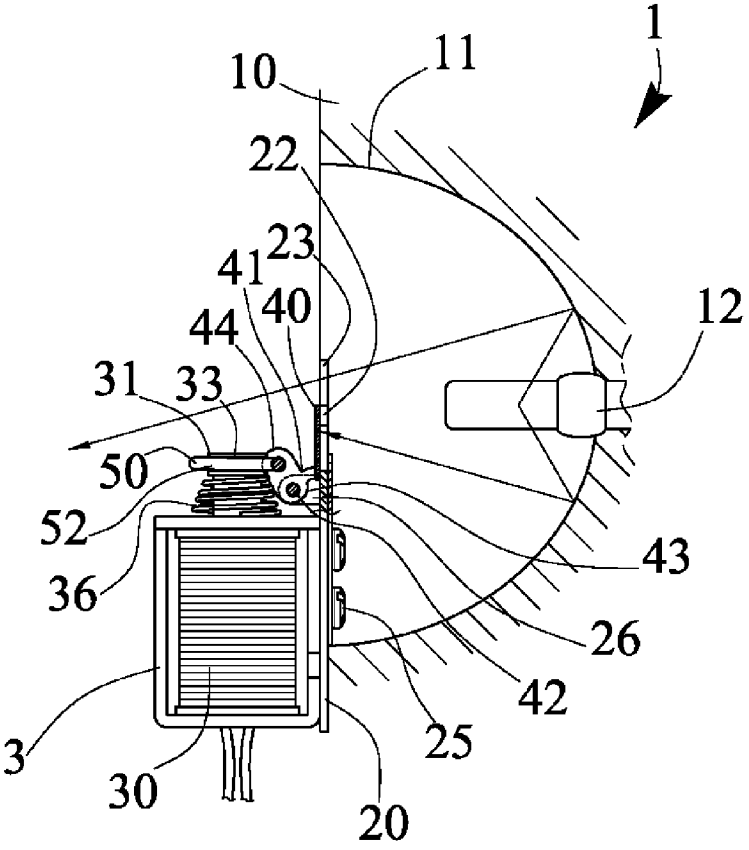
FIG. 1 is a side plan schematic view of a vehicle light beam adjusting device in accordance with the present invention.

Referring to the drawings, and initially to FIGS. 1 and 2, a vehicle headlight 1 in accordance with the present invention comprises a housing 10 including a reflector 11 disposed or provided therein, a light bulb or light device 12 disposed within the reflector 11 or attached or secured to the reflector 11 and/or extended into the reflector 11 for generating light beams, and arranged for allowing the light beams to be reflected by the reflector 11. A partition (not shown), a casing (not shown) and a lens, such as a convex lens, or transparent lens (not shown) may further be provided and secured to the front portion of the housing 10 with such as the latches or fasteners (not shown), in order to form the vehicle headlight 1.

Figure 3:
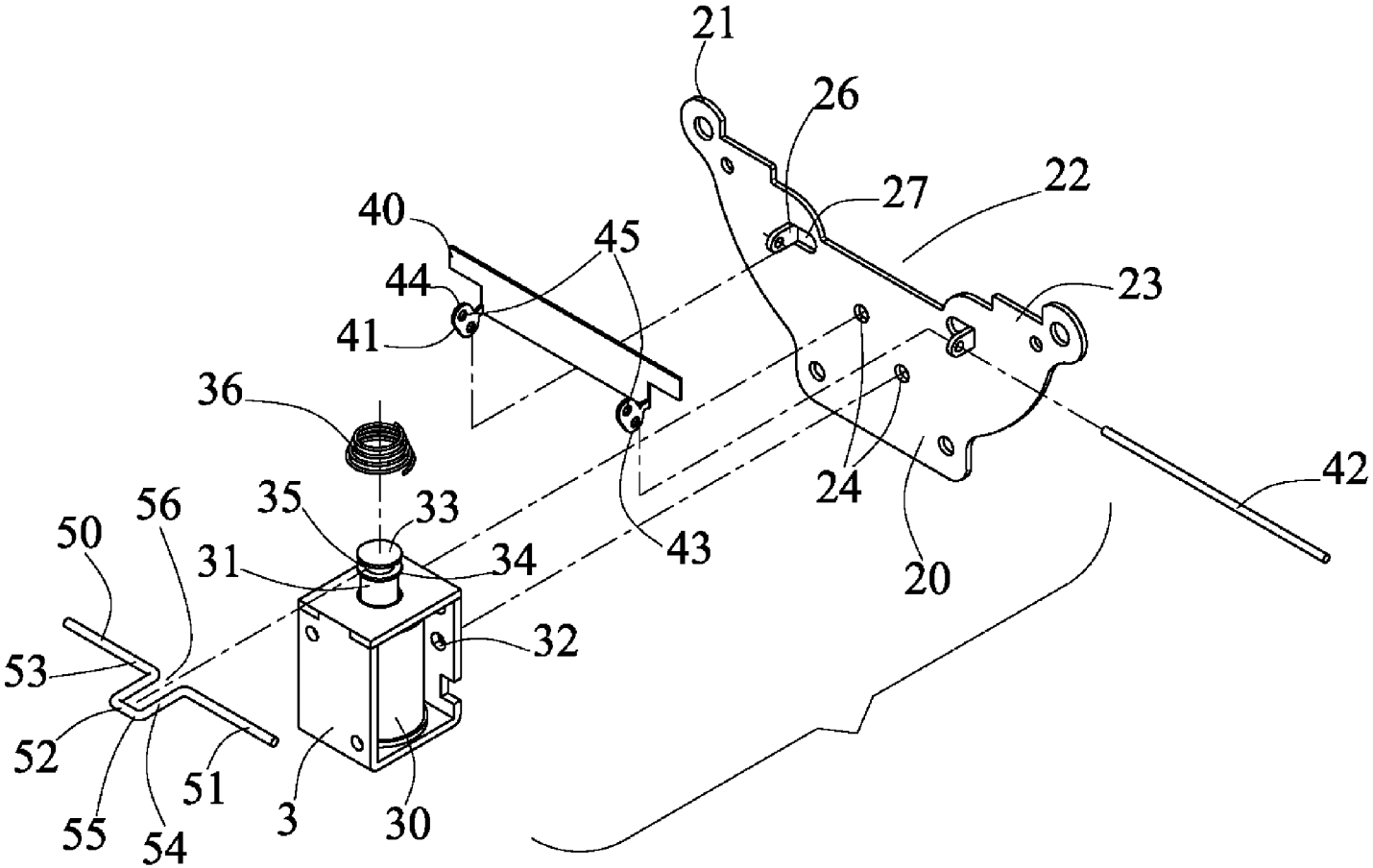
FIG. 3 is a partial exploded view illustrating the elements of the vehicle light beam adjusting device.

As shown in FIGS. 1-4, a frame 20 includes two end or side portions 21 attached or secured to the housing 10 or the partition with such as latches or fasteners (not shown), and includes a notch or passage 22 formed therein, such as formed in the upper portion 23 of the frame 20 and aligned with or located within the housing 10 and located in front of the light device 12 and the reflector 11, for allowing the light generated by the light device 12 to be selectively emitted out through the passage 22 of the frame 20 (FIG. 2). The frame 20 includes one or more apertures 24 formed therein (FIG. 3) for receiving fasteners 25 (FIGS. 1 and 2) which may be used to secure an actuating device or a solenoid device 3 to the frame 20, and the frame 20 includes one or more (such as two) ears 26 extended therefrom and each may be punched or formed from the frame 20 for forming or defining an opening 27 in the frame 20 (FIG. 3).

The solenoid device 3 includes a coil 30, a core 31 slidably received in the coil 30 and movable or actuatable by the coil 30. The solenoid device 3 includes one or more holes 32 formed therein (FIGS. 3, 4) for receiving the fasteners 25 (FIGS. 1, 2) which may secure the solenoid device 3 to the frame 20. It is preferable that the core 31 includes a narrowed neck portion or a head 33 formed or provided thereon, such as formed or provided on one end or free end portion thereof for forming or defining a peripheral shoulder 34 therein (FIG. 3), and includes an annular or peripheral depression or groove 35 formed in the head 33 (FIG. 3). A spring biasing member 36 may further be provided, and such as engaged onto and/or engaged with the core 31, and disposed or engaged between the solenoid device 3 and the peripheral shoulder 34 of the core 31 for biasing or moving or recovering the core 31 away from or relative to the coil 30 of the solenoid device 3.

A shielding panel 40 includes one or more (such as two) arms 41 extended therefrom and pivotally or rotatably attached or secured to the frame 20, such as to the ears 26 of the frame 20 with such as a pivot axle 42 for allowing the shielding panel 40 to be pivoted or rotated relative to the frame 20 with the pivot axle 42 (FIGS. 1, 2). The shielding panel 40 may also be directly and pivotally or rotatably attached or secured to or supported in the housing 10 without the frame 20. It is preferable that the arms 41 are inclined or tilted relative to the shielding panel 40, and the pivot axle 42 is located close to the shielding panel 40 and the frame 20 or attached to the root portion 43 of the arms 41, but distal to a free end portion 44 of the arms 41 (FIGS. 1, 2). The pivot axle 42 may be formed from or with a longitudinal wire or cable and may be anchored or positioned or secured to the partition or the housing 10 or the solenoid device 3 or the frame 20.

The pivotally or rotatably attaching or coupling of the shielding panel 40 to the frame 20 allows the shielding panel 40 to be pivoted or rotated relative to the frame 20 between an upwardly working position to selectively shield or block the passage 22 of the frame 20 (FIGS. 1, 4) and a downwardly or horizontally folding or receiving position to selectively open the passage 22 of the frame 20 (FIG. 2) and thus to allow the light generated by the light device 12 to selectively emit out through the passage 22 of the frame 20 when the shielding panel 40 is pivoted or rotated away from the passage 22 of the frame 20 or when the passage 22 of the frame 20 is opened by the shielding panel 40. The shielding panel 40 includes an orifice 45 formed in each of the arms 41 and located closer to the free end portion 44 of the arm 41, and distal to the root portion 43 of the arm 41.

A follower or actuator 50 includes two end rods 51 engaged through or coupled to the arms 41 of the shielding panel 40, such as engaged through the corresponding orifices 45 of the arms 41 and thus located closer to the free end portion 44 of the arms 41 but distal to the root portion 43 of the arms 41, or spaced away from the pivot axle 42, and the actuator 50 is provided for pivoting or rotating the shielding panel 40 relative to the frame 20 between the upwardly working position to selectively shield or block the passage 22 of the frame 20 (FIGS. 1, 4) and the downwardly or horizontally folding or receiving position to selectively open the passage 22 of the frame 20 (FIG. 2) by moving the actuator 50 up and down relative to the shielding panel 40 and the frame 20 and the solenoid device 3 with the core 31 of the solenoid device 3.

The actuator 50 may be folded or bent or machined or formed from or with a longitudinal wire or rod or cable that may include a circular or oval or elliptical cross section for allowing the actuator 50 to be suitably and smoothly pivoted or rotated relative to the arms 41 of the shielding panel 40.

For example, the actuator 50 includes a C or U-shaped engaging or retaining or coupling or anchoring member 52 formed or provided in the middle portion 53 thereof to slidably receive or engage with the annular groove 35 of the head 33 of the solenoid device 3; i.e., the anchoring member 52 may be engaged with the annular groove 35 of the head 33 of the core 31 of the solenoid device 3 to allow the actuator 50 to be engaged with or coupled to the core 31 of the solenoid device 3, and thus to allow the actuator 50 to be moved up and down relative to the shielding panel 40 and the frame 20 and the solenoid device 3 by the core 31 of the solenoid device 3, and thus to cause the shielding panel 40 to selectively shield or block the passage 22 (FIGS. 1, 4) or to selectively open the passage 22 of the frame 20 (FIG. 2). The sliding engagement of the anchoring member 52 of the actuator 50 with the annular groove 35 of the head 33 of the solenoid device 3 allows the anchoring member 52 of the actuator 50 to be slightly moved or slid relative to the core 31 of the solenoid device 3.

As best shown in FIG. 3, the actuator 50 includes a pair of parallel legs or limbs or side bars 54 slidably engaged with the annular groove 35 of the head 33 of the solenoid device 3, and an end bar 55 connected or coupled between the side bars 54 for forming or defining the C or U-shaped structure or configuration of the anchoring member 52 and for forming or defining a space or notch or opening 56 in the actuator 50, in which the opening 56 is formed and located between the side bars 54 and the end rods 51, and the end bar 55 is located distal to the end rods 51 and parallel to the end rods 51, and the opening 56 of the actuator 50 will be suitably blocked by the shielding panel 40 when the end rods 51 of the actuator 50 are pivotally or rotatably connecting or coupling to the arms 41 of the shielding panel 40, such that the core 31 of the solenoid device 3 may be solidly and stably connected or coupled or anchored or secured or retained to the actuator 50 and will not be separated or disengaged from the actuator 50. The end bar 55 may prevent the actuator 50 from being separated or disengaged from the core 31 of the solenoid device 3.

As shown in FIG. 2, the light generated by the light device 12 and reflected downwardly by the reflector 11 will not be blocked or shielded and may be selectively and freely emitted out through or out of the housing 10 to form a low beam. The other portion of the light generated by the light device 12 and reflected upwardly by the reflector 11 may be selectively emitted out through the passage 22 of the frame 20 (FIG. 2), but may also be selectively blocked or shielded by the shielding panel 40 (FIGS. 1, 4) when the shielding panel 40 is rotated upwardly relative to the frame 20 to block the passage 22 of the frame 20, by or with the core 31 of the solenoid device 3.

Figure 4:
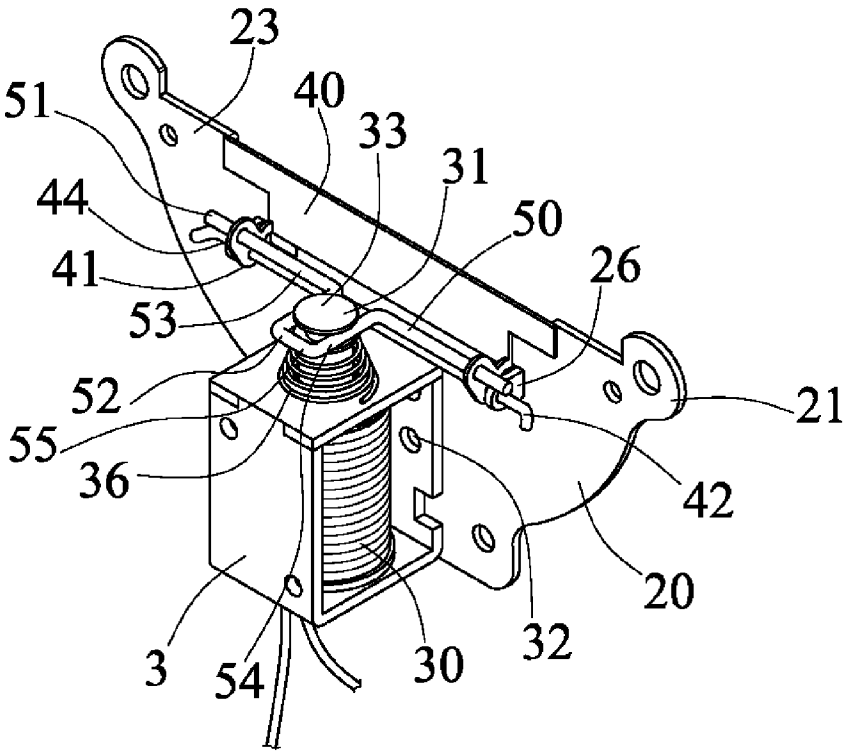
FIG. 4 is a partial perspective view of the vehicle light beam adjusting device.

In operation, as shown in FIGS. 1 and 4, when the actuating device or the solenoid device 3 has not be actuated or energized or operated, the spring biasing member 36 may bias or move or rotate the core 31 and the actuator 50 upwardly relative to the frame 20 to block the passage 22 of the frame 20, and thus to block and to prevent the other portion of the light generated by the light device 12 and reflected upwardly by the reflector 11 from being emitted or transmitted out through the passage 22 of the frame 20. At this moment, only a portion of the light generated by the light device 12 may be reflected and emitted downwardly by the reflector 11, and may be emitted or transmitted out through the housing to form the low beam. The light generated by the light device 12 and reflected upwardly by the reflector 11 will not be emitted or transmitted out through the housing 10 at this moment.

On the contrary, as shown in FIG. 2, the shielding panel 40 may be moved or actuated or pivoted or rotated relative to the frame 20 by the actuator 50 and/or the core 31 of the solenoid device 3 to selectively open the passage 22 of the frame 20, and thus to allow the other portion of the light generated by the light device 12 and reflected upwardly by the reflector 11 to be selectively emitted out through the passage 22 of the frame 20. At this moment, and simultaneously, the light generated by the light device 12 and reflected downwardly by the reflector 11 may also be emitted or transmitted out through the passage 22 of the frame 20 in order to form the high beam or to form a high intensity light beam together with the light reflected and emitted upwardly by the reflector 11.

The spring biasing device or spring biasing member 36 and the actuating device 3 may thus be formed and act as an actuating means or device for selectively causing or moving or rotating the shielding panel 40 to open or block the passage 22 of the frame 20, and thus for allowing the light reflected upwardly by the reflector 11 to be selectively blocked by the shielding panel 40 and by the actuating means or device formed or defined by the spring biasing devices or spring biasing member 36 and the actuating device 3. It is to be noted that the shielding panel 40 may be directly and pivotally attached to the housing 10, without the frame 20, to selectively open or block the passage 22 of the frame 20, and thus to allow the light generated by the light device 12 and reflected upwardly by the reflector 11 to be selectively opened or blocked by the shielding panel 40. It is further to be noted that a greatly simplified structure or configuration, including the frame 20 and the shielding panel 40 and the actuator 50 and the actuating device 3 may be formed and provided for adjusting the headlight to different light beams or to different light intensities.

Accordingly, the vehicle headlight in accordance with the present invention includes a light beam adjusting device for adjusting the headlight to different light beams or to different light intensities, and for preventing the light portion generated by the light bulb from being selectively reflected or emitted upwardly by the reflector of the vehicle headlight, and includes a greatly simplified structure for reducing the manufacturing cost and for simplifying the assembling procedures for the vehicle headlight.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A light beam adjusting device comprising:

a housing including a reflector, a light device attached to said reflector for generating light, and for allowing the light to be selectively reflected upwardly and to be selectively reflected downwardly by said reflector, the light reflected downwardly by said reflector being allowed to emit out through said housing, a frame attached to said housing, and including a passage formed therein for allowing the light reflected upwardly by said reflector to selectively emit out through said passage of said frame, and including two ears extended therefrom, a shielding panel including two arms extended therefrom and pivotally coupled to said ears of said frame with a pivot axle to allow said shielding panel to be pivoted relative to said frame with said pivot axle and to be pivoted relative to said frame between an upwardly working position to selectively block said passage of said frame and a downwardly receiving position to selectively open said passage of said frame, a solenoid device including a coil and a core slidably received in said coil and movable relative to said solenoid device by said coil, said core including a head provided on a free end portion thereof and having an annular groove formed in said head, an actuator including two end rods coupled to said arms of said shielding panel respectively and spaced away from said pivot axle, and including a U-shaped anchoring member provided in a middle portion thereof to slidably engage with said annular groove of said head and to be slidably coupled to said core of said solenoid device for rotating said shielding panel relative to said frame to selectively open and block said passage of said frame, said anchoring member including two side bars slidably engaged with said annular groove of said head of said solenoid device and an end bar connected between said side bars for forming said U-shaped structure of said anchoring member and for forming an opening in said actuator, said opening being formed and located between said side bars and said end rods, and said end bar being located distal to said end rods and parallel to said end rods for stably anchoring and retaining said head of said solenoid device to said actuator and for preventing said anchoring member of said actuator from being separated and disengaged from said core of said solenoid device, and a spring biasing member engaged onto said core and engaged with said core for biasing said core relative to said coil of said solenoid device, said core of said solenoid device being coupled to said anchoring member of said actuator for actuating said actuator to rotate said shielding panel to selectively open said passage of said frame and to allow the light reflected upwardly by said reflector to selectively emit out through said passage of said frame, said spring biasing member biasing said core and said actuator to rotate said shielding panel to selectively block said passage of said frame and to prevent the light reflected upwardly by said reflector from emitting out through said passage of said frame when said core is not actuated by said coil of said solenoid device, the light reflected upwardly by said reflector forming a high beam together with the light reflected downwardly by said reflector when said passage of said frame is opened and is not blocked by said shielding panel.

2. The vehicle light beam adjusting device as claimed in claim 1, wherein said actuator is formed with a longitudinal cable having a circular cross section.

3. The vehicle light beam adjusting device as claimed in claim 1, wherein said core includes a peripheral shoulder formed by said head and engaged with said spring biasing member.

4. The vehicle light beam adjusting device as claimed in claim 1, wherein said arms of said shielding panel each include a root portion and a free end portion, said pivot axle is attached to said root portions of said arms of said shielding panel, and said end rods of said actuator are attached to said free end portions of said arms of said shielding panel.

5. The vehicle light beam adjusting device as claimed in claim 1, wherein said arms of said shielding panel are tilted relative to said shielding panel.

* * * * *